United States Patent [19]

Ditzig

[11] Patent Number: 4,730,682

[45] Date of Patent: Mar. 15, 1988

[54] EROSION RESISTANT ROCK DRILL BIT

[75] Inventor: Joseph R. Ditzig, Portland, Pa.

[73] Assignee: Ingersoll-Rand Company, Woodcliff Lake, N.J.

[21] Appl. No.: 812,267

[22] Filed: Dec. 23, 1985

[51] Int. Cl.[4] ..... E21B 10/60

[52] U.S. Cl. ..... 175/393; 175/400

[58] Field of Search ..... 175/393, 400, 401, 410

[56] References Cited

U.S. PATENT DOCUMENTS

| | | | |
|---|---|---|---|
| Re. 29,300 | 7/1977 | Bender | 175/410 |
| 3,955,635 | 5/1976 | Skidmore | 175/400 |
| 4,069,880 | 1/1978 | Johnstone et al. | 175/410 |
| 4,151,889 | 5/1979 | Lister | 175/410 |
| 4,299,298 | 11/1981 | McEnery et al. | 175/400 |
| 4,440,244 | 4/1984 | Wiredal | 175/410 |

*Primary Examiner*—Stephen J. Novosad
*Assistant Examiner*—Terry L. Melius
*Attorney, Agent, or Firm*—W. C. Vliet

[57] ABSTRACT

Disclosed herein is an erosion resistant down hole rock drill bit which utilizes a radial distribution of carbide cutter bits or buttons about the exhaust hole. This minimizes carbide wash or removal of base metal which retains the carbide and thereby extends bit life.

5 Claims, 3 Drawing Figures

EROSION RESISTANT ROCK DRILL BIT

FIELD OF INVENTION

The present invention relates to rock drill bits primarily used in rock boring for blast holes, water and oil wells and the like.

BACKGROUND OF THE INVENTION

Recent advances in carbide insert and rock drill bit design have increased the life of gage buttons (for example by the use of longer length buttons, double gage row, shot peened holes, etc.) to the point where face buttons become the predominate mode of failure. Often severe wash on the face removes adequate support of the button, and eventually the carbide button support will be weakened to the point of permitting button failure or simply loss of the button.

BRIEF SUMMARY OF THE INVENTION

The present invention teaches the distribution of carbide cutter inserts such as carbide buttons in a radial line outward from the exhaust hole. This prevents the free flow of exhaust wash which carries abrasive rock particles about the base metal surrounding the carbides.

The object of the invention therefor, is to prevent an unrestricted wash path to the carbide inserts.

A further object of the invention is to establish preferred wash paths which do not approximate carbide button locations.

Yet a further object is to provide an extended life carbide cutter bit which is economical to manufacture.

These and other objects are obtained in a carbide button bit comprising:

a body having a longitudinal axis extending parallel to the direction of drilling;

a face disposed on the body towards the front or leading edge of the body and perpendicular to the longitudinal axis of the body;

the face accessing a source of pressure fluid at a source point on the face; and a plurality of cutting means for effecting rock cutting disposed on the face in a manner such that the cutting means are disposed in a pattern extending along lines of radial extension form the source point.

DETAILED DESCRIPTION OF THE PREFERRED EMBODIMENT

Figure 1:
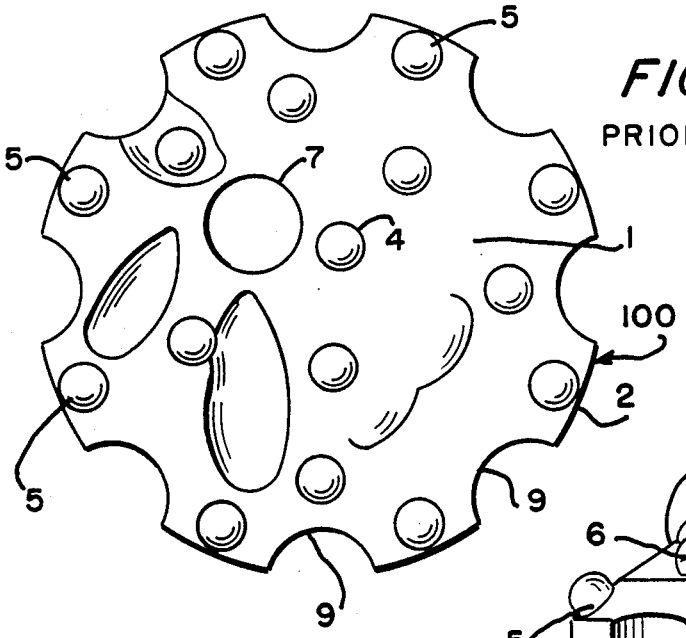
FIG. 1 PRIOR ART
FIG. 1 shows the plan view of an eroded carbide button bit according to the prior art.

Referring first to the prior art embodiment shown in FIG. 1. A typical erosion pattern is shown by the shaded areas of the bit face. The present invention minimizes the erosion of the bit face by placing the carbide button in radial alignment on the face of the bit about the relieved exhaust port. This promotes flow between the buttons rather than by the button by providing a free flow path on the one hand and a multiplicity of flow restrictions where possible in the other.

Figure 2:
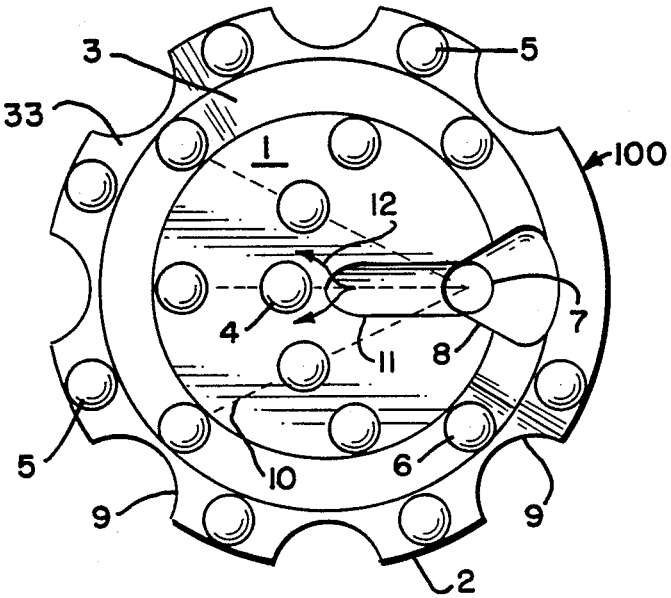
FIG. 2 shows the plan view of a carbide button bit according to the present invention.

Referring specifically to FIG. 2, a drill bit body in general is shown and referred to by reference numeral 100.

The body has a longitudinal axis parallel to direction of drilling 20 and a lead edge containing a face portion and a beveled or sloped portion. Concentric about the axis is a gauge portion which forms the periphery and a shank portion which extends rearward form the leading edge to connect with a drill (not shown).

The face of the bit is referred to by reference numeral 1, the gauage of the bit is referred to by reference numeral 2, and a sloped portion of the bit connecting the face and gauge as numeral 3. As can be seen in FIG. 2, face buttons are identified by reference numeral 4, gauge buttons as 5 and intermediate buttons as 6. The exhaust port 7 is shown predominately entering the intermediate sloping portion 3 with a relief channel 8 and a directional flow channel 11 extending towards and on the face 1. The directed flow channel 11 promotes directed flow of exhaust fluid across the face of the bit in a manner indicated by the flow arrows 12.

The gauge 2 of the cutter bit is further provided with a series of seven (7) peripheral relief cuts 9 which facilitate the flow of exhaust fluid and/or drilling mud from the exhaust port to behind the bit towards the drill string to eventually exit the drill hole along the drill string (not shown) in a manner conventional to down hole drilling.

The location of the buttons or carbide cutter bit inserts according to this invention are in radial alignment extending from the exhaust port. Dotted lines 10 show the radial lines of extension. Exhaust fluid can thereby pass unimpeded between the rows of buttons while at the same time the carbide buttons impede the flow to a maximum extent by being in line. The effect of this is to reduce the erosion of base metal in the area of the buttons thereby preserving their mounting integrity and life.

Figure 3:
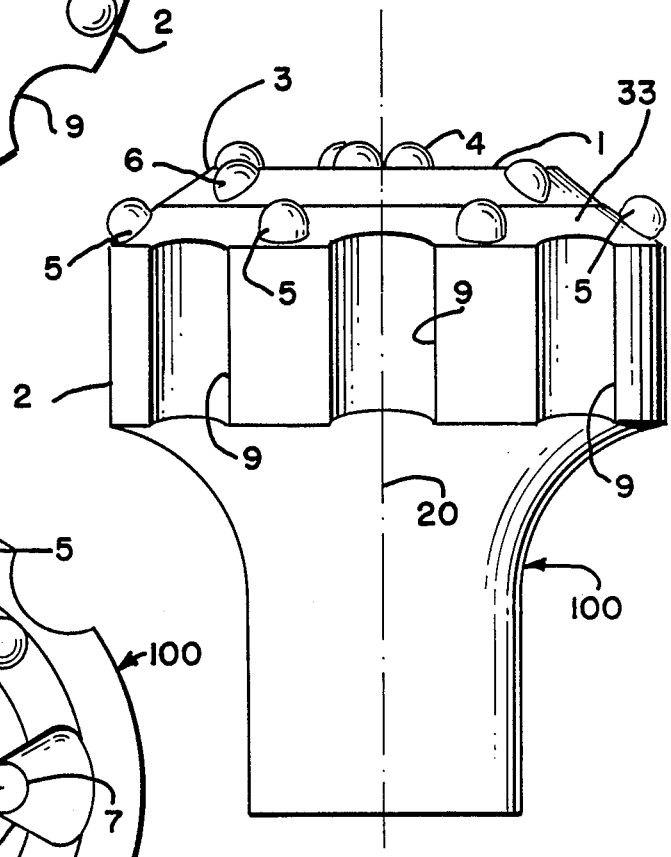
FIG. 3 shows the elevation view of a carbide button bit according to the present invention.

Referring to FIG. 3, the elevation view of the cutter bit is shown. As can be seen, the bit is further provided with a shank portion 11 for mating with the drill (not shown). The drill bit attached to the drill is rotated and/or receives a percussive blow to grind and/or crush the rock below the bit. The small pieces thus formed are washed from the hole by means of pressure fluid such as air, drilling mud or water in a conventional manner well-known to the drilling art.

Having described my invention in detail, numerous variations of the specific layout of buttons will occur to those skilled in the art and I do not wish to be limited in the scope of my invention except as claimed.

I claim:

1. A rock drill bit of generally cylindrical form adapted for attachment to a drill at its one back end comprising:

a cylindrical body having a longitudinal axis extending parallel to the direction of drilling;

a cutting face disposed on said body towards the other or front end of said body and oriented in a plane perpendicular to said longitudinal axis of said body;

said face being accessed by a source of pressure fluid at a source point on said face;

said source point further being provided with a means for directing pressure fluid across said face in a preferred direction;

a plurality of cutting means for effecting rock cutting disposed on said face along at least one line of radial extension from said source point in said preferred direction of resulting flow; and said means for directing pressure fluid comprises a predominately cross flow channel oriented perpendicular to said axis and extending in a shallowing manner radially outward with reducing depth from the face as it progresses from said source point in said preferred direction.

2. A rock drill bit according to claim 1 wherein:

said pressure fluid is a drilling mud.

3. A rock drill bit according to claim 1 wherein:

said pressure fluid is air.

4. A rock drill bit according to claim 1 wherein:

said cutting means comprise carbide inserts.

5. A rock drill bit according to claim 1 wherein:

said cutting means comprise carbide inserts disposed on said face and about the guage periphery of said bit.

* * * * *